US009328635B2

(12) United States Patent
Nutter

(10) Patent No.: US 9,328,635 B2
(45) Date of Patent: May 3, 2016

(54) RETROFITTING PERFORMANCE CAMSHAFTS TO AN INTERNAL COMBUSTION ENGINES WITH HEMISPHERICAL COMBUSTION CHAMBERS

(71) Applicant: Arthur Clyde Nutter, Brush Prairie, WA (US)

(72) Inventor: Arthur Clyde Nutter, Brush Prairie, WA (US)

( * ) Notice: Subject to any disclaimer, the term of this patent is extended or adjusted under 35 U.S.C. 154(b) by 281 days.

(21) Appl. No.: 14/223,426

(22) Filed: Mar. 24, 2014

(65) Prior Publication Data

US 2014/0283383 A1 Sep. 25, 2014

Related U.S. Application Data

(60) Provisional application No. 61/804,456, filed on Mar. 22, 2013.

(51) Int. Cl.
*F01L 1/04* (2006.01)
*F01L 1/047* (2006.01)
*F01L 1/02* (2006.01)

(52) U.S. Cl.
CPC ..... *F01L 1/047* (2013.01); *F01L 1/022* (2013.01); *Y10T 29/49233* (2015.01)

(58) Field of Classification Search
CPC ..... F01L 1/047; F01L 1/022; B23P 6/00; B23P 11/00; Y10T 29/49716; Y10T 29/49233
USPC ..... 29/888.011, 401.1, 402.09
See application file for complete search history.

(56) References Cited

U.S. PATENT DOCUMENTS

2013/0068189 A1* 3/2013 Beyer ..... F02F 1/24 123/193.5
2013/0118001 A1* 5/2013 Nutter ..... F02D 45/00 29/593
2014/0216373 A1* 8/2014 Church ..... F01L 1/3442 123/90.15

* cited by examiner

*Primary Examiner* — David Bryant
*Assistant Examiner* — Steven A Maynard

(57) ABSTRACT

A method for installing a camshaft retrofitting kit into an internal combustion engine with a plurality of hemispherical combustion chambers in order to provide increased power. A variable camshaft timing (VCT) assembly and a plurality of displacement-on-demand (DOD) control solenoids are replaced with a VCT plug and a plurality of DOD plugs respectively. A performance camshaft is installed in place of a stock camshaft, and a performance camshaft drive assembly is installed in place of a stock camshaft drive assembly. A cam adapter may also be provided in order to extend the length and diameter of the performance camshaft. Additionally, a plurality of springs from a plurality of cam followers is replaced with a plurality of spacers.

19 Claims, 13 Drawing Sheets

RETROFITTING PERFORMANCE CAMSHAFTS TO AN INTERNAL COMBUSTION ENGINES WITH HEMISPHERICAL COMBUSTION CHAMBERS

The current application claims a priority to the U.S. Provisional Patent application Ser. No. 61/804,456 filed on Mar. 22, 2013. The current application is filed on Mar. 24, 2014 while Mar. 22, 2014 was on a weekend.

FIELD OF THE INVENTION

The present invention relates generally to a system for increasing the power of an internal combustion engine. More specifically, to a method for retrofitting performance camshafts to internal combustion engines having a plurality of hemispherical combustion chambers.

BACKGROUND OF THE INVENTION

The first Chrysler "Hemi" V8 engines appeared on the market in 1951. Since that time, said "Hemi" engines have been used extensively in the custom car field, being modified and swapped into countless custom vehicles, and in racing form, achieving dominance in several forms of motor racing.

The contemporary implementation of the Chrysler "Hemi" V8 engine first appeared on the market in 2003, in the 5.7 liter version. Since that time, Chrysler Corp.

has produced other versions, including 6.1 liter and 6.4 liter engines. The fuel delivery and spark delivery systems on the contemporary versions of the "Hemi", like all contemporary automotive engines, are controlled by a dedicated purpose computer, known as an Engine Control Unit, or ECU.

During the 2009 production run, Chrysler Corporation improved their 5.7 Liter Hemi Engines with regard to better fuel economy and reduced emissions performance by the installation of a Variable Camshaft Timing (VCT) system and a Displacement-on-Demand (DOD) system in those engines. Under the control of an upgraded ECU, the VCT system changes the angular position of the camshaft with respect to the crankshaft as a function of the power being requested from the engine (driver's gas pedal position) and engine revolutions per minute (RPM). With VCT, the engine system can provide lower emissions and greater economy in response to real time conditions.

The DOD system deactivates half of the engine's cylinders (alternate cylinders in the firing order) under conditions of low power demand, which reduces engine pumping losses under conditions of high manifold vacuum, thereby providing significant increases in fuel economy and reductions in emissions-per-mile.

There is an expanding demand for late model Chrysler Hemi engines in the custom car, aftermarket and high-performance automobile construction fields. In many of those projects, the customer wants the engine to be modified to produce significantly greater power than does the stock engine.

One of the essential modifications along the path to greater engine power is the replacement of the conservative factory camshaft with a "performance" camshaft that opens and closes the valves faster than the stock camshaft, opens and closes the valves at different points in the operating cycle than does the stock camshaft, and lifts the valves higher than does the stock camshaft.

Unfortunately, the VCT and DOD systems preclude the replacement of the stock factory camshaft with a performance camshaft. There are two reasons for that limitation.

First, the effective range of camshaft position adjustment which the VCT system provides would guarantee that, as a result of the higher valve lift values that performance camshafts attain, all the valves would collide with the pistons at the extremes of VCT adjustment travel. That would cause immediate, severe engine damage and probable engine destruction.

Secondly, performance camshafts impose acceleration rates on the cam followers that are substantially greater that those embodied in the stock camshaft. That causes much higher axial forces to be imposed on the DOD-style cam followers at high engine speeds, and those higher forces overpower the DOD cam followers' ability to remain in the non-collapsed (active) position, causing the DOD cylinders to unintentionally deactivate at high power-high rpm operation.

It is therefore an object of the present invention to provide the ability to install a performance camshaft in the new VCT-style Hemi engines by means of replacing the VCT and DOD components with suitable alternatives.

DETAIL DESCRIPTIONS OF THE INVENTION

All illustrations of the drawings are for the purpose of describing selected versions of the present invention and are not intended to limit the scope of the present invention.

The present invention is a camshaft retrofitting kit that improves the standard power of an internal combustion engine with a plurality of hemispherical combustion chambers. The internal combustion engine with a plurality of hemispherical combustion chambers is different from other combustion engines, mainly due to hemispherical shaped combustion chambers, where the hemispherical shaped combustion chambers provide lower heat escape and higher peak pressure. The internal combustion engine with a plurality of hemispherical combustion chambers is hereinafter referred to as the hemispherical internal combustion engine. The present invention provides a low cost and efficient method for retrofitting performance engine parts, wherein the method can be carried out by an individual who has a basic knowledge of internal combustion engines.

Figure 1:
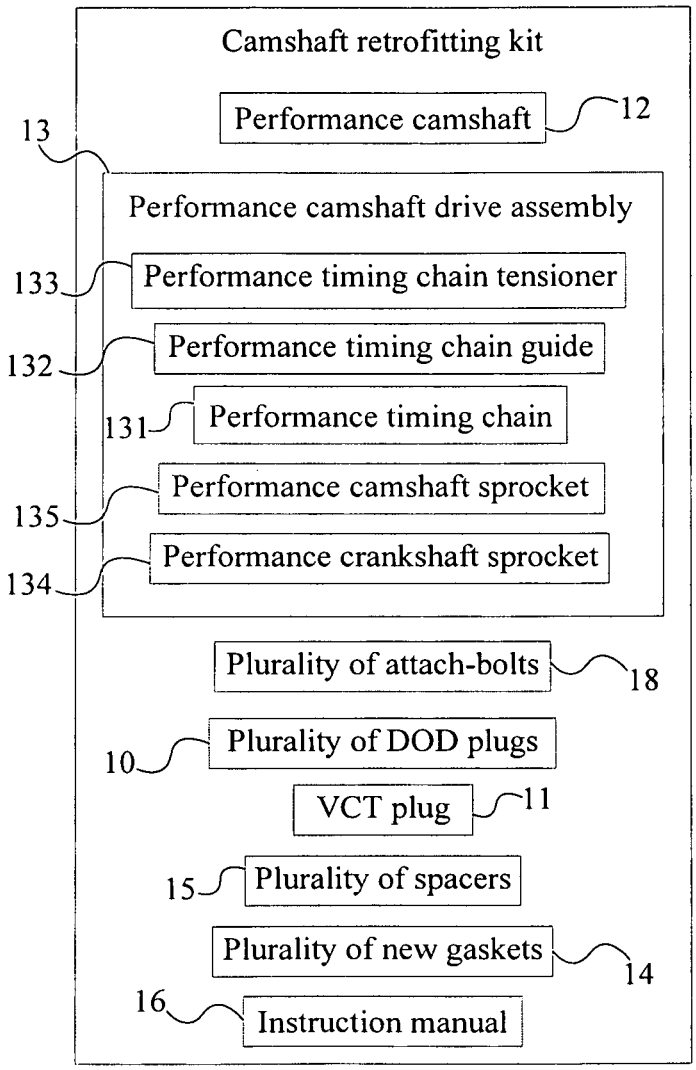
FIG. 1 is a diagram of the camshaft retrofitting kit.

In reference to FIG. 1, the camshaft retrofitting kit comprises a plurality of displacement-on-demand (DOD) plugs 10, a variable camshaft timing (VCT) plug 11, a performance camshaft 12, a performance camshaft drive assembly 13, a plurality of spacers 15, a plurality of new gaskets 14, and an instruction manual 17. The performance camshaft drive assembly 13 comprises a performance timing chain 131, a performance timing chain guide 132, a performance timing chain tensioner 133, a performance crankshaft sprocket 134, and a performance camshaft sprocket 135.

Figure 2:
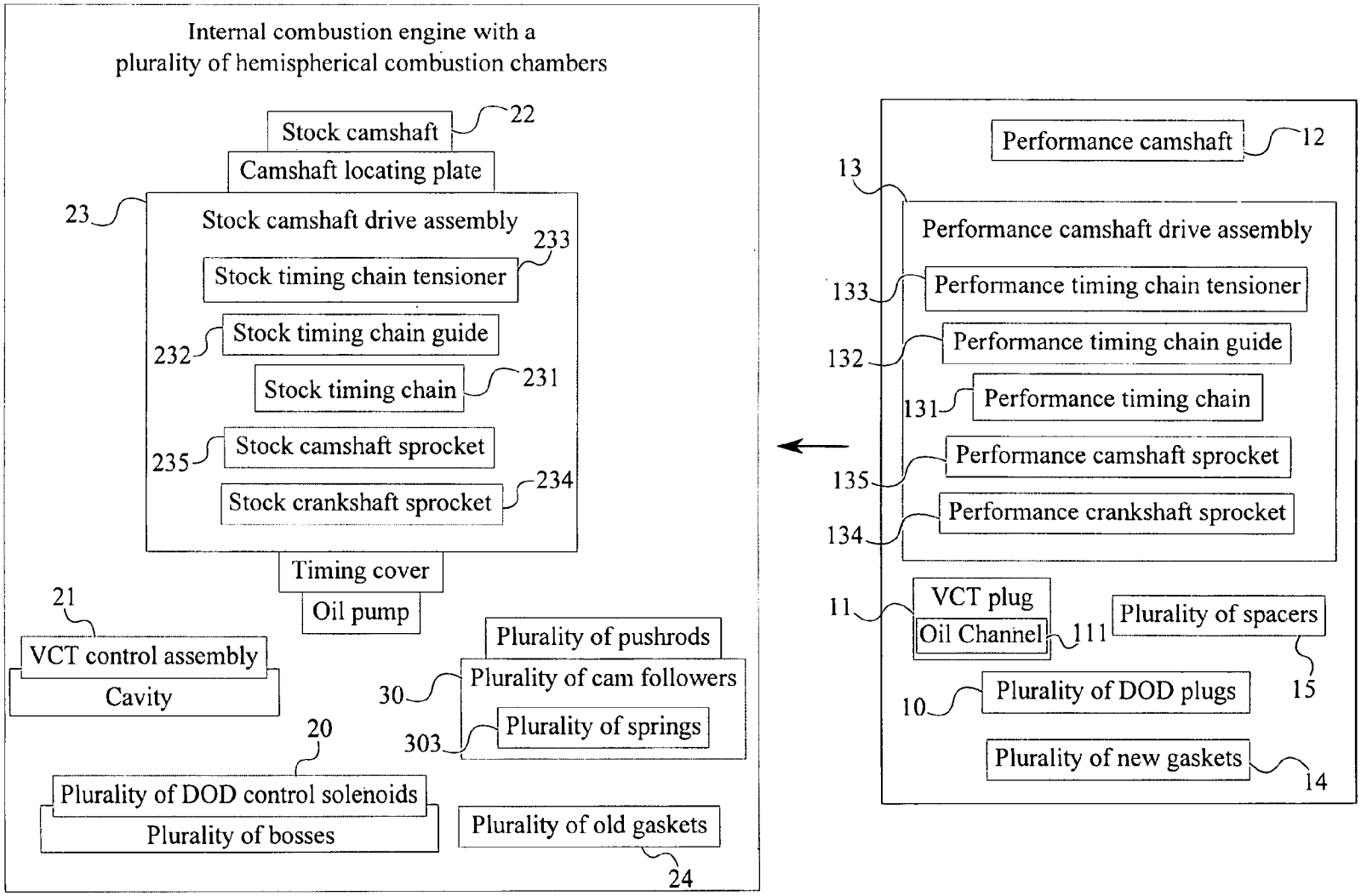
FIG. 2 is a diagram displaying the components of the camshaft retrofitting kit to be swapped with the stock components of the hemispherical internal combustion engine.

In reference to FIG. 2, the hemispherical internal combustion engine comprises an engine block, an oil pan, an intake manifold assembly, a pair of rocker covers, a pair of cylinder heads, a plurality of pushrods, a timing cover, an oil pump, a stock camshaft drive assembly 23, a camshaft locating plate, a stock camshaft 22, a crankshaft, a VCT control assembly 21, a plurality of DOD control solenoids 20, and a plurality of cam followers 30. The stock camshaft drive assembly 23 comprises a stock timing chain 231, a stock timing chain guide 232, a stock timing chain tensioner 233, a stock crankshaft sprocket 234, a stock camshaft sprocket 235, and a plurality of old gaskets 24. The engine block comprises a valley, which is obstructed by the intake manifold assembly. The instruction manual 17 provides detailed, step by step instructions for the method for retrofitting performance engine parts, such that the individual can properly install the other components of the camshaft retrofitting kit to the hemispherical internal combustion engine.

In a vehicle containing the hemispherical internal combustion engine, a number of components hinder access to the hemispherical internal combustion engine, namely an air conditioning assembly, an alternator, a power steering assembly, and a water pump of the vehicle. As such, the air conditioning assembly, the alternator, the power steering assembly, and the water pump are removed from the vehicle using standard disassembling techniques and practices known in the automotive industry in order to gain access to the hemispherical internal combustion engine. The oil pan is then unbolted from the engine block in order to remove the oil pan from the engine block and gain access to the oil pump and the timing cover. If the oil pan does not readily detach from the engine block, then a sharpened putty knife or screwdriver may be used to separate the oil pan from the engine block.

In order to gain access to the valley of the engine block, the intake manifold assembly is unbolted from the engine block. The intake manifold assembly is then removed from the engine block and set aside. Once the intake manifold assembly has been removed, the pair of rocker covers and the pair of cylinder heads can then be detached from the engine block as well in order to gain access to the plurality of push rods and in turn the plurality of cam followers 30. Each of the pair of rocker covers is unbolted from the pair of cylinder heads and then removed and set aside. Similarly, each of the pair of cylinder heads is unbolted from the engine block and then removed and set aside.

Figure 3:
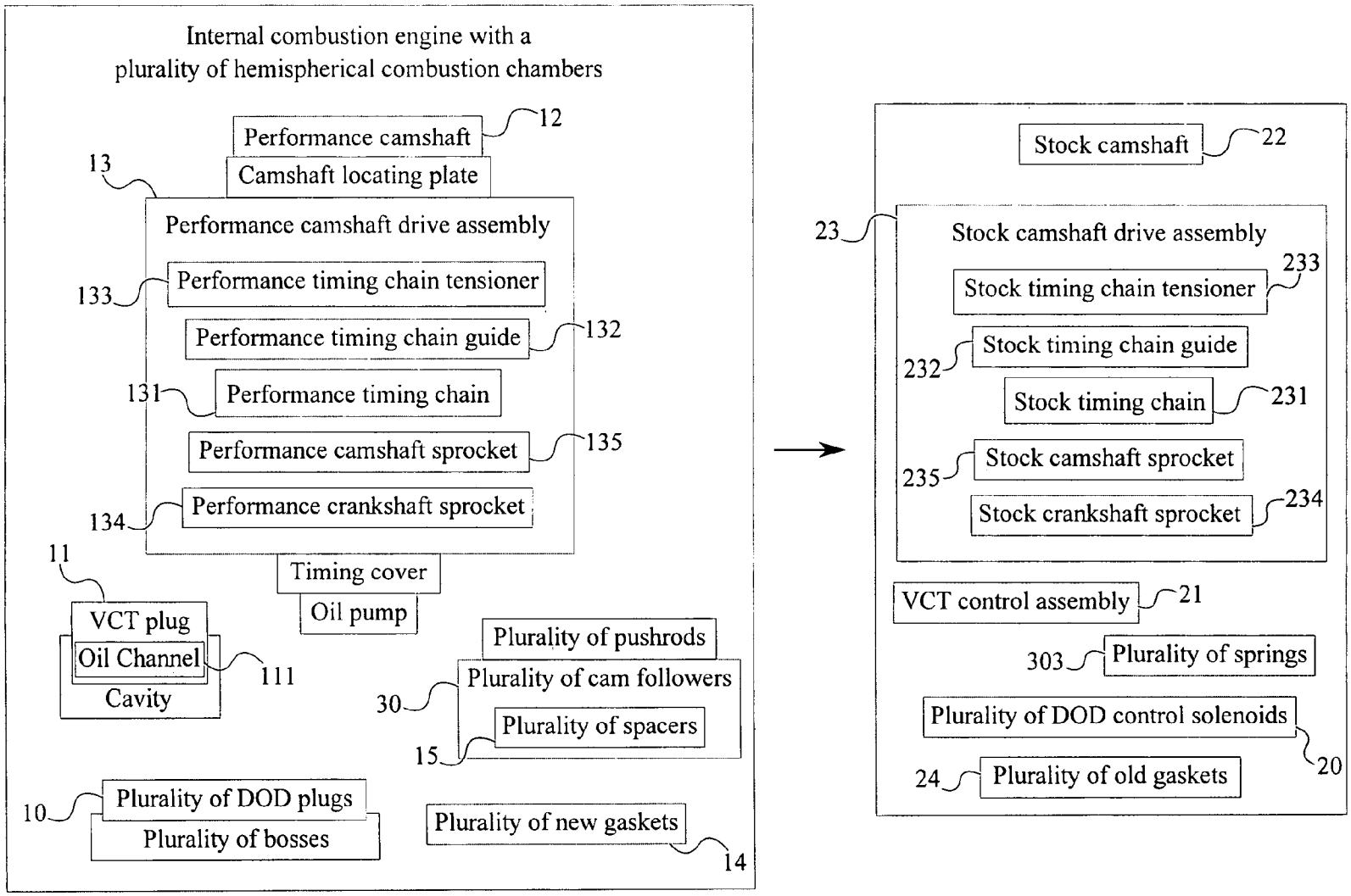
FIG. 3 is a diagram displaying the stock components being replaced by the performance components in the hemispherical internal combustion engine.
Figure 9:
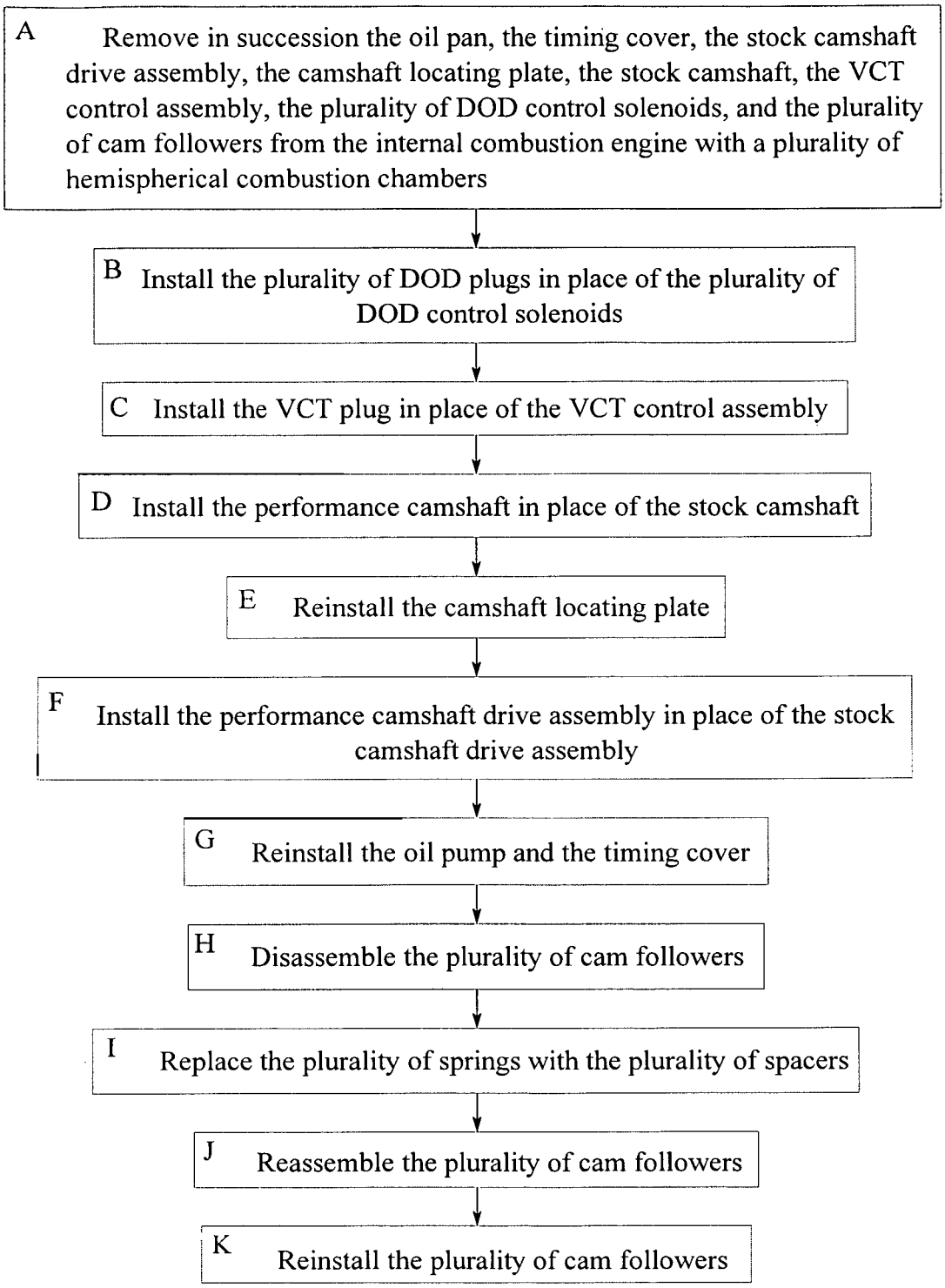
FIG. 9 is a flowchart provisioning the main steps for retrofitting the hemispherical internal combustion engine.

In reference to FIG. 3 and FIG. 9, once the oil pan, the intake manifold assembly, the pair of rocker covers, and the pair of cylinder heads have been removed, the hemispherical internal combustion engine can be further dismantled. Namely, the oil pump, the timing cover, the stock camshaft drive assembly 23, the camshaft locating plate, the stock camshaft 22, the VCT control assembly 21, the plurality of DOD control solenoids 20, the plurality of pushrods, and the plurality of cam followers 30 are removed in succession from the engine block of the hemispherical internal combustion engine.

Figure 12:
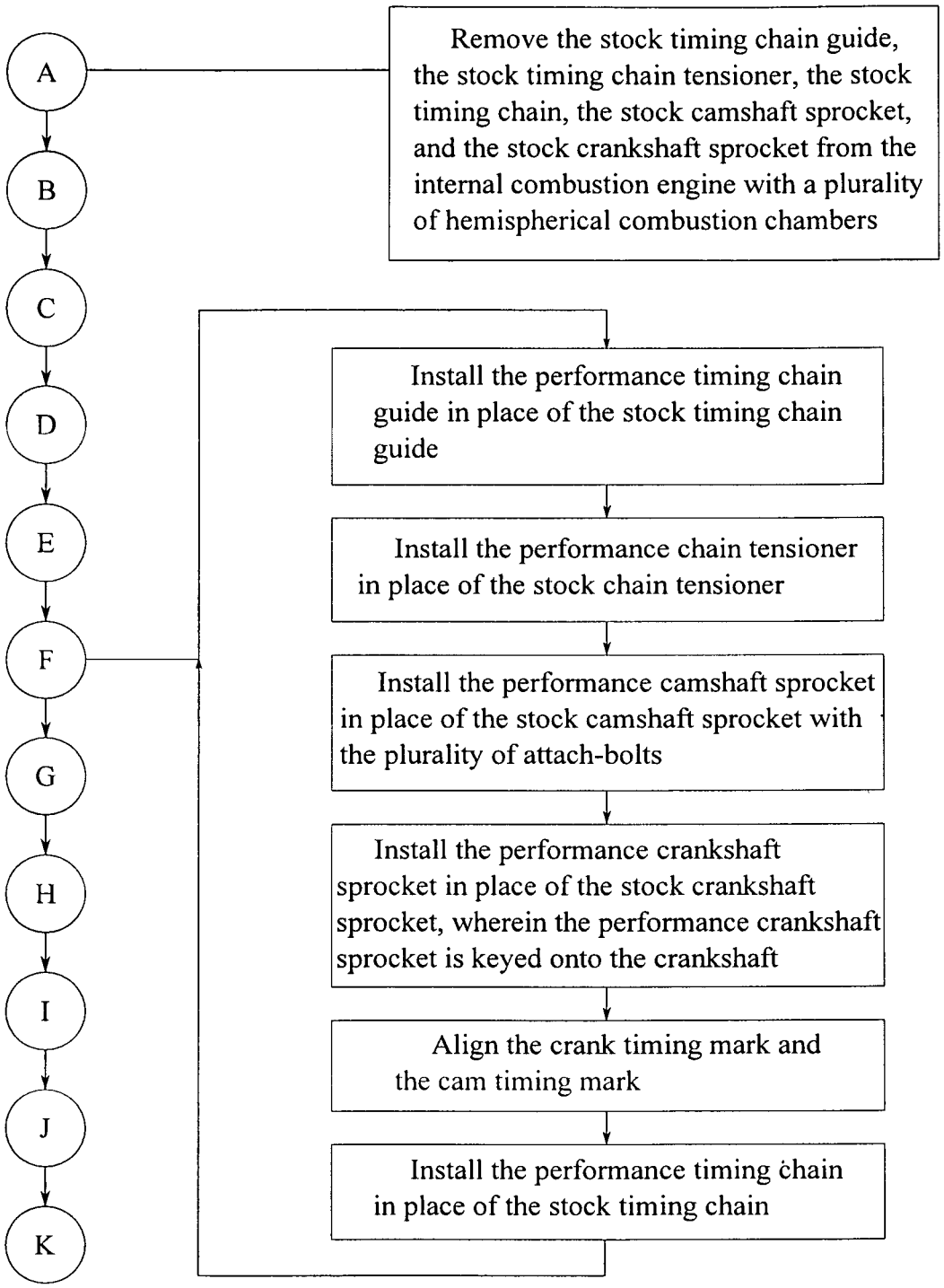
FIG. 12 is a flowchart thereof showing a detailed removal of the stock camshaft drive assembly components and a detailed installation of the performance camshaft drive assembly components.

In reference to FIG. 9 and FIG. 12, the timing cover, the camshaft locating plate, the stock camshaft 22, the VCT control assembly 21, the plurality of DOD control solenoids 20, the plurality of pushrods, and the plurality of cam followers 30 are removed from the engine block using standard techniques and practices known in the automotive industry. Similarly, the stock timing chain guide 232, the stock timing chain tensioner 233, the stock timing chain 231, the stock crankshaft sprocket 234, and the stock camshaft sprocket 235 of the stock camshaft drive assembly 23 are removed from the engine block using standard techniques and practices known in the automotive industry.

In reference to FIG. 2, the plurality of DOD control solenoids 20 resides in the valley of the engine block and acts to deactivate the plurality of pushrods for selected cylinders of the hemispherical internal combustion engine. The plurality of DOD control solenoids 20 is positioned into a plurality of bosses, wherein the plurality of bosses is in fluid communication with the plurality of cam followers 30. When installed, the plurality of DOD control solenoids 20 provides a pressurized oil signal to the plurality of cam followers 30, allowing the plurality of cam followers 30 to control the intake valve operation in order to activate and deactivate the selected cylinders of the hemispherical internal combustion engine.

In reference to FIG. 3 and FIG. 9, once the plurality of DOD control solenoids 20 is removed from the plurality of bosses, the plurality of DOD plugs 10 is installed in place of the plurality of DOD control solenoids 20. The plurality of DOD plugs 10 is positioned into the plurality of bosses in order to prevent the flow of oil to the plurality of cam followers 30. In this way, the hydraulic actuation function of the plurality of cam followers 30 is disabled, and thus the selected cylinders of the hemispherical internal combustion engine are always activated.

In reference to FIG. 2, the VCT control assembly 21 comprises a VCT control valve and a VCT control solenoid. The VCT control valve is positioned into a cavity of the engine block, while the VCT control solenoid is connected to and positioned above the VCT control valve. The cavity is in fluid communication with the stock camshaft 22. When installed, the VCT control solenoid is electronically controlled in order to actuate the VCT control valve. The VCT control valve acts to regulate the flow of high pressurized oil to the stock camshaft 22 in order to adjust timing of the stock camshaft 22.

Figure 4:
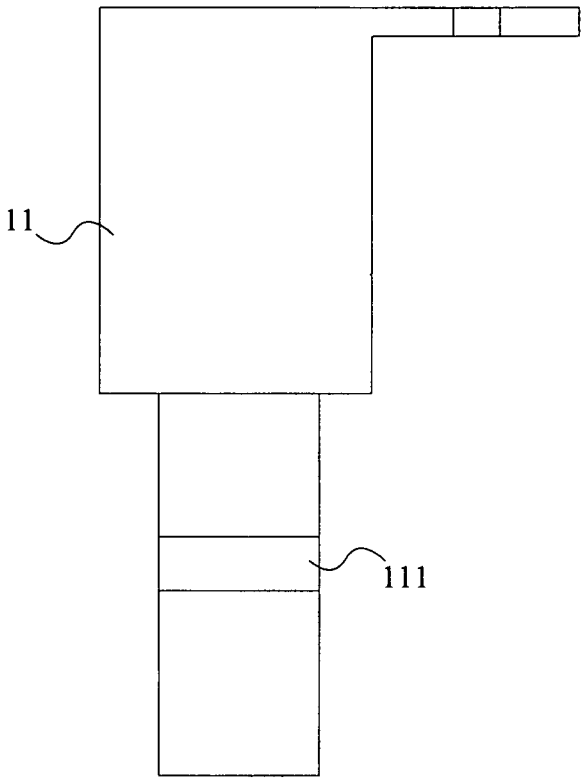
FIG. 4 is a front sectional view of the variable camshaft timing plug.

In reference to FIG. 3-4 and FIG. 9, once the VCT control assembly 21 is removed from the cavity, the VCT plug 11 is installed in place of the VCT control assembly 21. The VCT plug 11 comprises an oil channel 111. The oil channel 111 is positioned into the cavity and the VCT plug 11 is bolted to the engine block. The oil channel 111 allows the high pressurized oil to be directed to the performance camshaft 12, once the performance camshaft 12 has been installed. However, the high pressurized oil is delivered at a constant rate, as the VCT plug 11 does not comprise a means for limiting the high pressurized oil through the oil channel 111. In this way, the timing of the performance camshaft 12 is constant.

Figure 5:
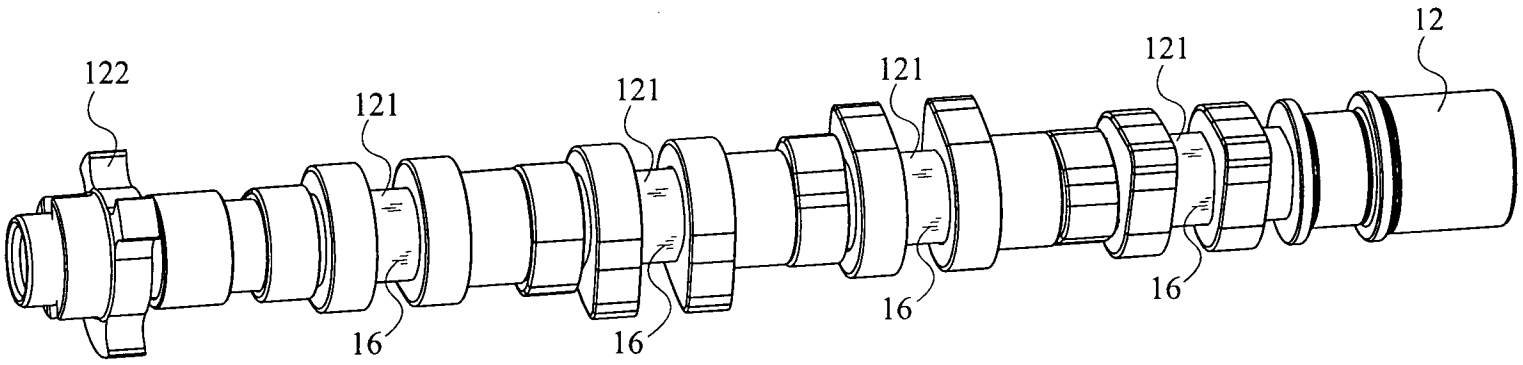
FIG. 5 is a perspective view of the performance camshaft showing the assembly lubricant applied to the plurality of bearing journals.
Figure 10:
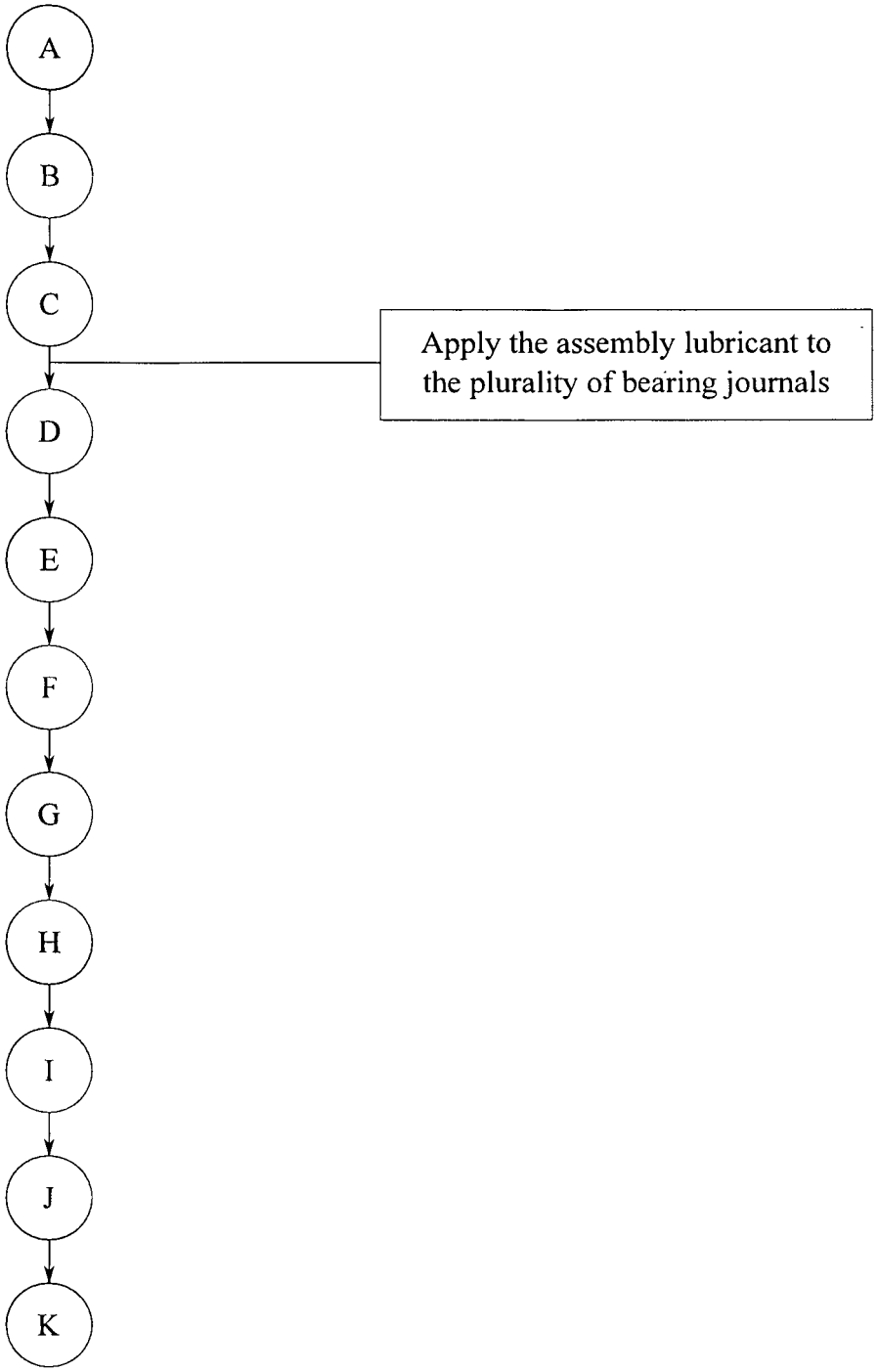
FIG. 10 is a flowchart thereof showing the application of the assembly lubricant.
Figure 11:
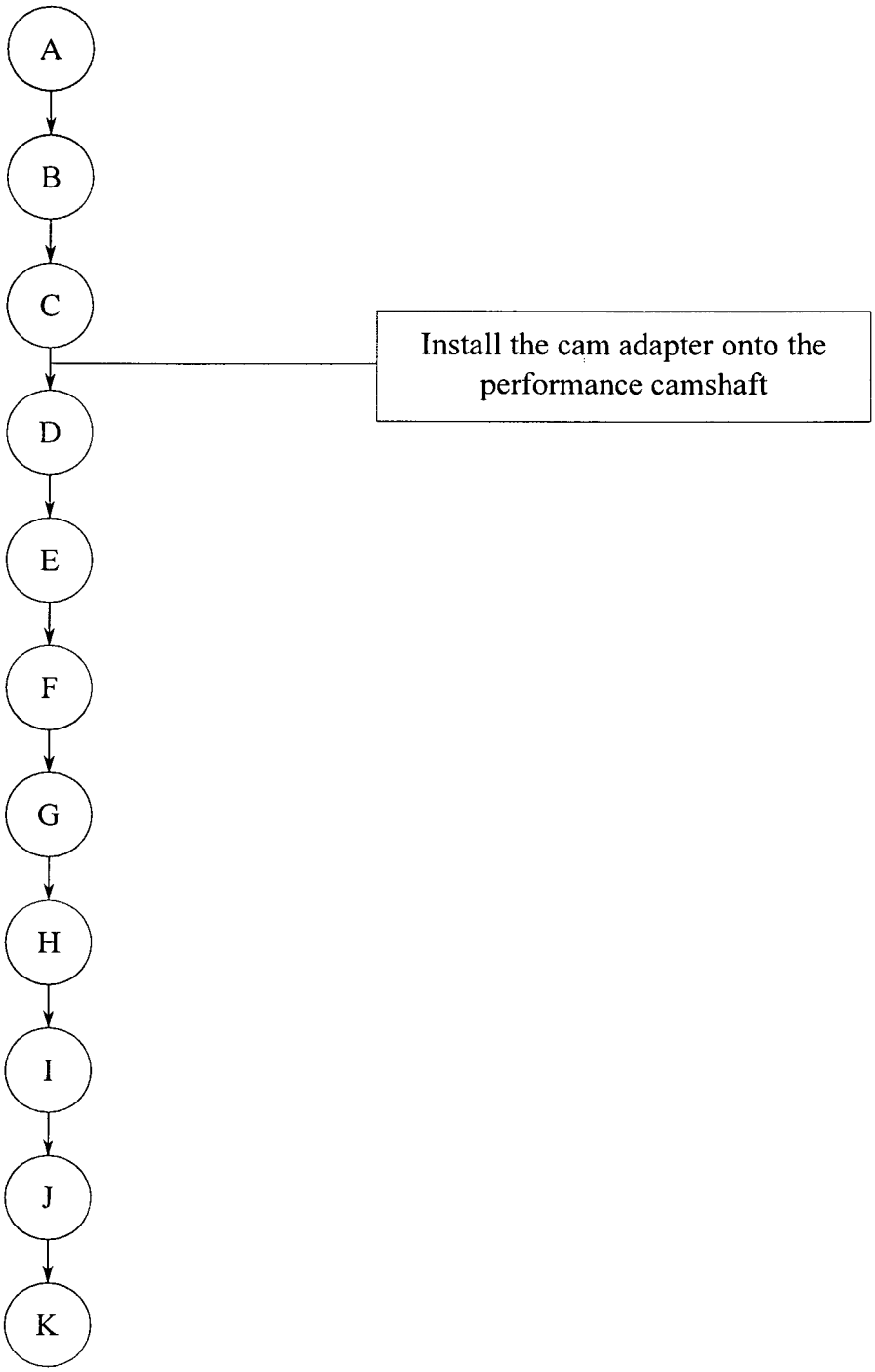
FIG. 11 is a flowchart thereof showing the additional use of the cam adapter.

In further reference to FIG. 3 and FIG. 9-10, the performance camshaft 12 is installed in place of the stock camshaft 22. The performance camshaft 12 differs from the stock camshaft 22 in that the performance camshaft 12 is able to attain valve lift values that are higher than valve lift values of the stock camshaft 22. This provides the reason for replacing the VCT control assembly 21 with the VCT plug 11, as the adjustments in the timing of the performance camshaft 12 would cause valves to collide with pistons within the hemispherical internal combustion engine. The performance camshaft 12 comprises a plurality of bearing journals 121, to which an assembly lubricant 16 is applied before the performance camshaft 12 is installed into the engine block. The assembly lubricant 16 facilitates rotation of the performance camshaft 12 within the engine block. Once the performance camshaft 12 is installed, the camshaft locating plate is reinstalled onto the engine block. In reference to FIG. 5 and FIG. 11, the performance camshaft 12 comprises a front cam bearing that is positioned into a front bearing bore of the engine block. The camshaft locating plate is positioned around the front bearing bore. Depending on the model of the performance camshaft 12 to be used, the front cam bearing may have a diameter significantly smaller than the diameter of the front bearing bore and the performance camshaft 12 may not be of sufficient length for the front cam bearing to engage the front bearing bore. As such, the camshaft retrofitting kit may further comprise a cam adapter 122. The cam adapter 122 is connected to the front of the performance camshaft 12 and acts to increase the diameter of the front cam bearing, as well as extend the length of the performance camshaft 12.

In reference to FIG. 12, similar to the performance camshaft 12, the performance camshaft drive assembly 13 is installed in place of the stock camshaft drive assembly 23.

More specifically, the performance timing chain guide 132 is installed in place of the stock timing chain guide 232, the performance chain tensioner is installed in place of the stock timing chain tensioner 233, the performance timing chain 131 is installed in place of the stock timing chain 231, the performance crankshaft sprocket 134 is installed in place of the stock crankshaft sprocket 234, and the performance camshaft sprocket 135 is installed in place of the stock camshaft sprocket 235. The performance camshaft drive assembly 13 acts to provides increased efficiency and horsepower of the hemispherical internal combustion engine as compared to the stock camshaft drive assembly 23.

Figure 6:
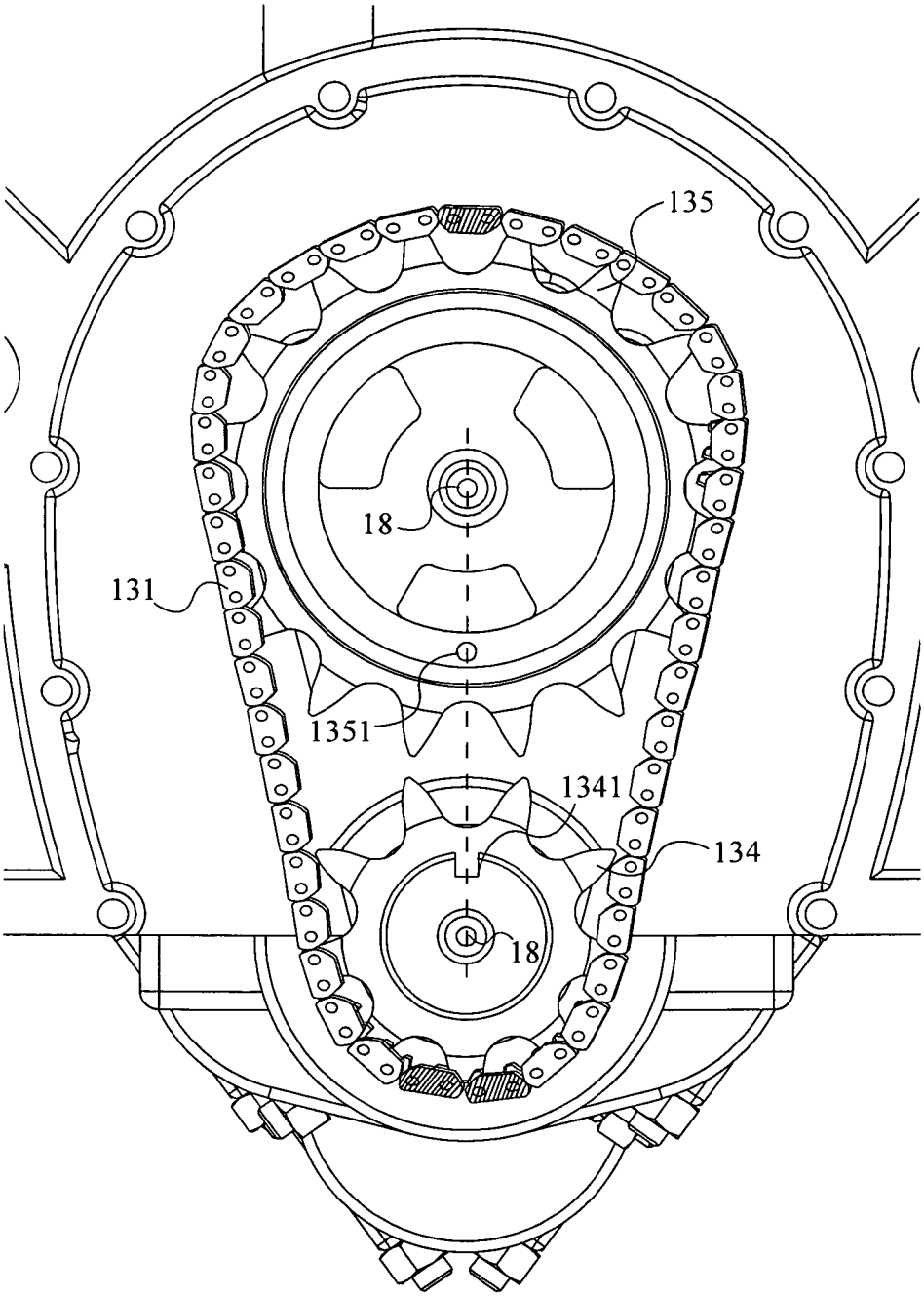
FIG. 6 is a front view of the hemispherical internal combustion engine showing the crank timing mark aligned with the cam timing mark.

In reference to FIG. 6, both the performance timing chain tensioner 133 and the performance timing chain guide 132 are bolted onto the engine block using existing bolts and bolt holes used to secure the stock timing chain tensioner 233 and the stock timing chain guide 232 to the engine block. The camshaft retrofitting kit further comprises a plurality of attach-bolts 18. The plurality of attach-bolts 18 is used to secure the performance camshaft sprocket 135 to the performance camshaft 12. Once the performance camshaft sprocket 135 is secured, the performance crankshaft sprocket 134 is keyed onto the crankshaft. The performance camshaft sprocket 135 comprises a cam timing mark 1351, while the performance crankshaft sprocket 134 comprises a crank timing mark 1341. When the performance camshaft sprocket 135 and the performance crankshaft sprocket 134 are installed, the cam timing mark 1351 is aligned with the crank timing mark 1341 in order to ensure proper timing of the performance camshaft 12 and the crankshaft. The performance timing chain 131 is positioned around both the performance camshaft sprocket 135 and the performance crankshaft sprocket 134.

In reference to FIG. 9, once the performance camshaft drive assembly 13 is installed, both the oil pump and the timing chain cover are reinstalled. The oil pump is reinstalled making sure that there is proper clearance for the performance chain tensioner.

Figure 13:
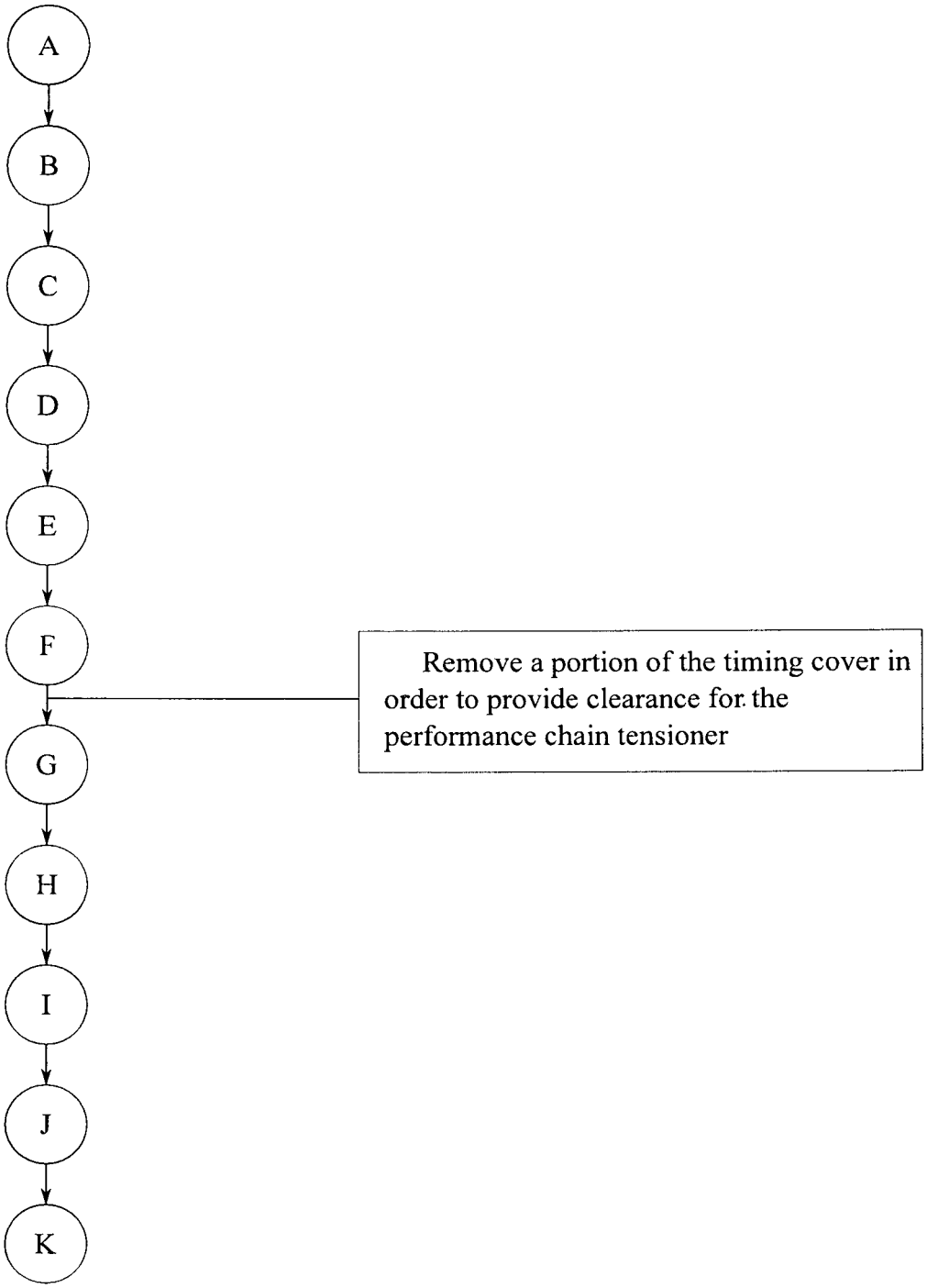
FIG. 13 is a flowchart thereof showing the removal of a portion of the timing cover to provide clearance for the performance chain tensioner.

The timing cover is bolted to the engine block over top of the performance camshaft drive assembly 13. In reference to FIG. 13, depending on the timing cover, a portion of the timing cover may need to be removed prior to reinstallation in order to provide clearance for the performance chain tensioner. In reference to FIG. 14, the plurality of new gaskets 14 comprises a timing cover gasket; the timing cover gasket replacing an old timing cover gasket from the plurality of old gaskets 24. The timing cover gasket is positioned in between the timing cover and the engine block when the timing cover is reinstalled.

Figure 7:
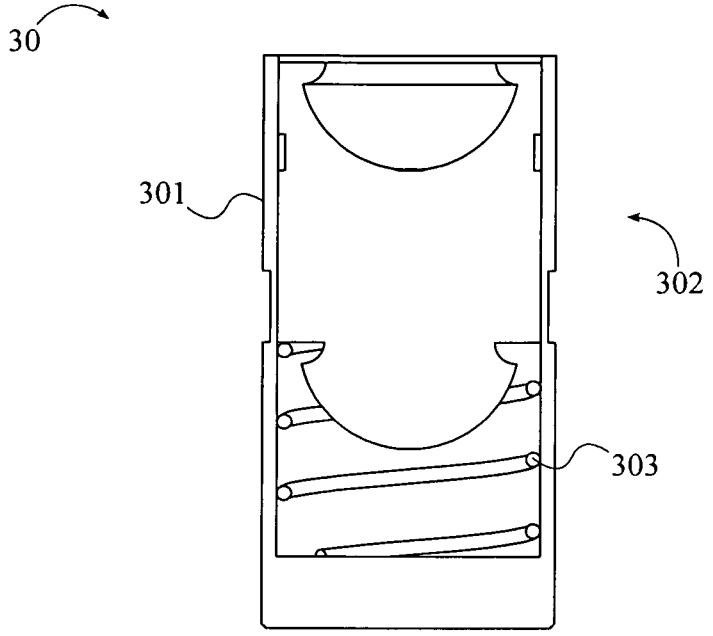
FIG. 7 is a front sectional view of one of the plurality of cam followers in the stock configuration with the plurality of springs.
Figure 8:
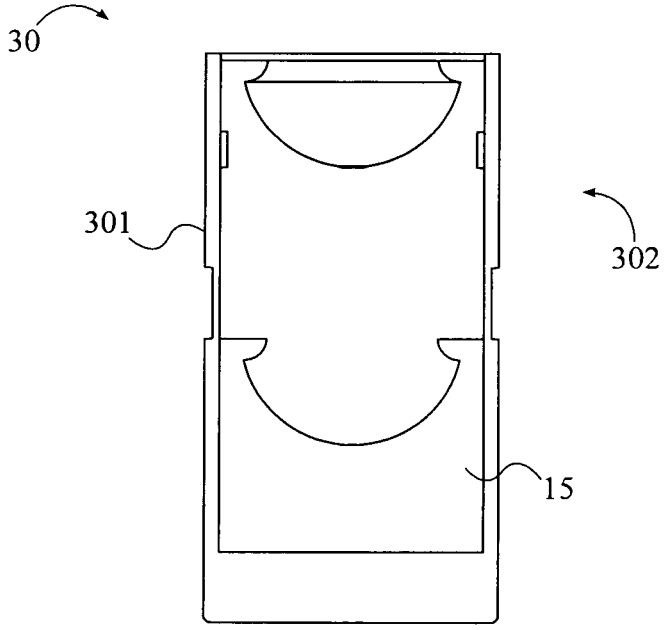
FIG. 8 is a front sectional view thereof showing the plurality of springs being replaced with a spacer.

In reference to FIG. 7-8, each of the plurality of cam followers 30 is a multi-displacement system (MDS) lifter and comprises a body 301, a hydraulics assembly 302, and a plurality of springs 303. Both the hydraulics assembly 302 and the plurality of springs 303 are positioned within the body 301; the hydraulics assembly 302 being positioned above the plurality of springs 303. The plurality of cam followers 30 is disassembled, removing both the hydraulics assembly 302 and the plurality of springs 303 from the body 301 for each of the plurality of cam followers 30, wherein the plurality of cam followers 30 is specifically eight MDS lifters. The plurality of springs 303 is then replaced by the plurality of spacers 15 and the plurality of cam followers 30 is reassembled. Each of the plurality of spacers 15 is a cylindrical extrusion of solid material. In this way, each of the plurality of cam followers 30 is converted from a spring activated MDS lifter to a conventional acting hydraulic lifted in order to keep the plurality of cam followers 30 from collapsing under the MDS actions. The plurality of cam followers 30 is then reinstalled within the engine block along with the plurality of pushrods.

Figure 14:
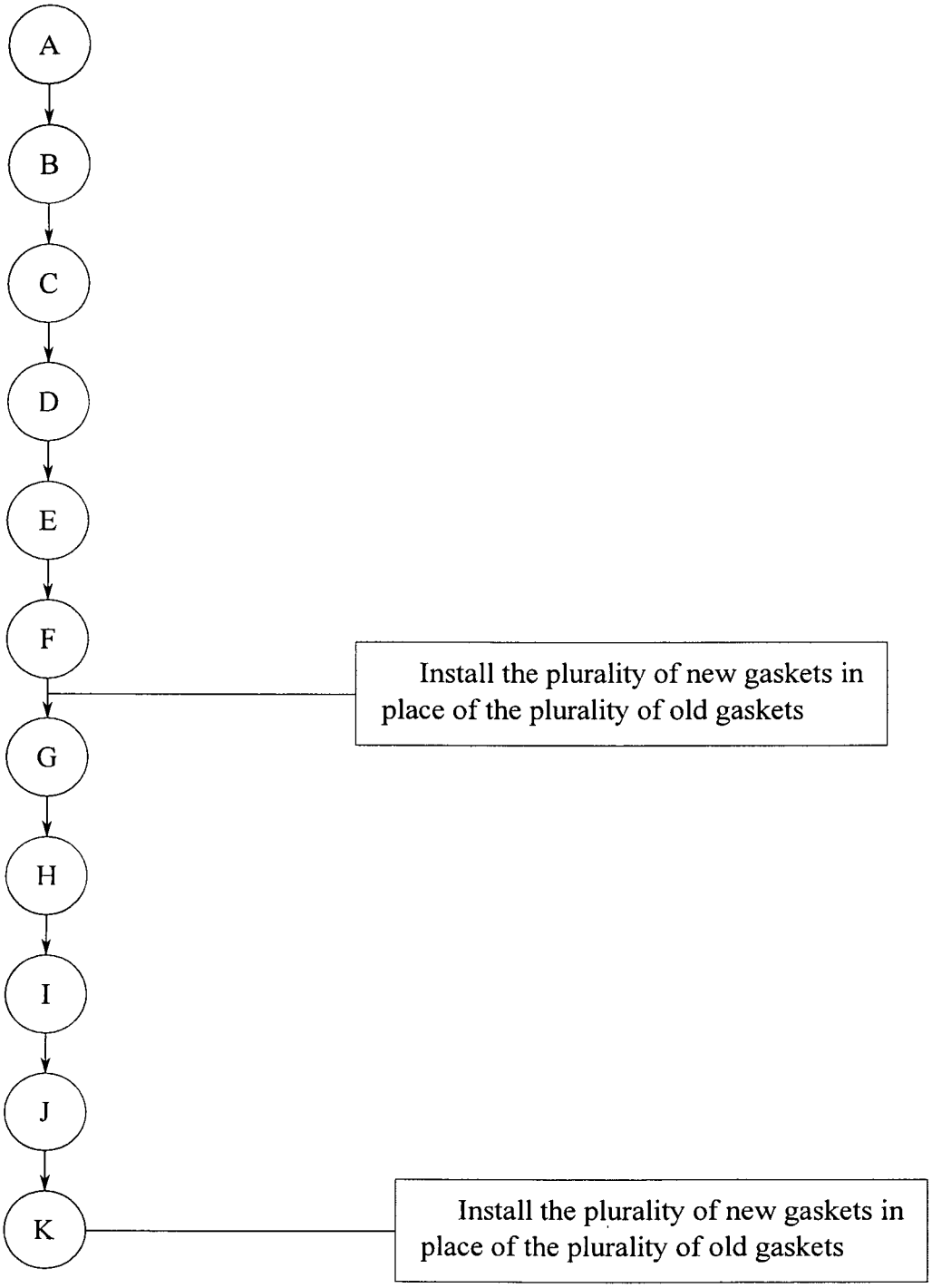
FIG. 14 is a flowchart thereof showing the installation of the plurality of new gaskets in place of the plurality of old gaskets.

The pair of cylinder heads, the pair of rocker covers, the intake manifold, and the oil pan are then reinstalled in succession. The plurality of new gaskets 14 further comprises a pair of cylinder head gaskets, an oil pan gasket, and an intake manifold gasket. The plurality of new gaskets 14 acts to replace the plurality of old gaskets 24 of the hemispherical internal combustion engine, as shown in FIG. 14, as each of the plurality of old gaskets 24 becomes worn over time. In addition to the old timing cover gasket, the plurality of old gaskets 24 further comprises an old pair of cylinder head gaskets, an old oil pan gasket, and an old intake manifold gasket. The pair of cylinder head gaskets is positioned in between the pair of cylinder heads and the engine block in place of the old pair of cylinder head gaskets when the pair of cylinder heads is reinstalled. Similarly, the oil pan gasket is positioned in between the oil pan and the engine block in place of the old oil pan gasket, and the intake manifold gasket is positioned in between the intake manifold assembly and the engine block in place of the old intake manifold gasket. The water pump, the power steering assembly, the alternator, and the air conditioning assembly are then reinstalled into the vehicle.

Although the invention has been explained in relation to its preferred embodiment, it is to be understood that many other possible modifications and variations can be made without departing from the spirit and scope of the invention as hereinafter claimed.

What is claimed is:

1. A method for retrofitting high performance camshafts to gasoline-fueled piston engines comprises the steps of:

providing an internal combustion engine with a plurality of hemispherical combustion chambers, wherein the internal combustion engine with a plurality of hemispherical combustion chambers comprises a timing cover, an oil pump, a stock camshaft drive assembly, a camshaft locating plate, a stock camshaft, a variable camshaft timing (VCT) control assembly, a plurality of displacement-on-demand (DOD) control solenoids, and a plurality of cam followers;

providing a camshaft retrofitting kit, wherein the camshaft retrofitting kit comprises a plurality of DOD plugs, a VCT plug, a performance camshaft, a performance camshaft drive assembly, and a plurality of spacers;

removing the timing cover, the oil pan, the stock camshaft drive assembly, the camshaft locating plate, the stock camshaft, the VCT control assembly, the plurality of DOD control solenoids, and the plurality of cam followers from the internal combustion engine with a plurality of hemispherical combustion chambers;

installing the plurality of DOD plugs in place of the plurality of DOD control solenoids;

installing the VCT plug in place of the VCT control assembly;

installing the performance camshaft in place of the stock camshaft;

reinstalling the camshaft locating plate;

installing the performance camshaft drive assembly in place of the stock camshaft drive assembly;

reinstalling the oil pump and the timing cover;

disassembling the plurality of cam followers, wherein the plurality of cam followers comprises a plurality of springs;

replacing the plurality of springs with the plurality of spacers;

reassembling the plurality of cam followers; and reinstalling the plurality of cam followers.

2. The method for retrofitting high performance camshafts to gasoline-fueled piston engines as claimed in claim 1 further comprises the steps of:

providing an assembly lubricant and the performance camshaft, wherein the performance camshaft comprises a plurality of bearing journals; and applying the assembly lubricant to the plurality of bearing journals.

3. The method for retrofitting high performance camshafts to gasoline-fueled piston engines as claimed in claim 1 further comprises the steps of:

providing a cam adapter; and installing the cam adapter onto the performance camshaft.

4. The method for retrofitting high performance camshafts to gasoline-fueled piston engines as claimed in claim 1 further comprises the steps of:

providing both a performance crankshaft sprocket and a performance camshaft sprocket for the performance camshaft drive assembly, wherein the performance crankshaft sprocket comprises a crank timing mark, and wherein the performance camshaft sprocket comprises a cam timing mark; and aligning the crank timing mark and the cam timing mark.

5. The method for retrofitting high performance camshafts to gasoline-fueled piston engines as claimed in claim 1 further comprises the steps of:

providing a performance camshaft sprocket and a plurality of attach-bolts for the performance camshaft drive assembly; and installing the performance camshaft sprocket with the plurality of attach-bolts.

6. The method for retrofitting high performance camshafts to gasoline-fueled piston engines as claimed in claim 1 further comprises the steps of:

providing the stock camshaft drive assembly, wherein the stock camshaft drive assembly comprises a stock timing chain guide, a stock timing chain tensioner, a stock timing chain, a stock crankshaft sprocket, and a stock camshaft sprocket; and removing the stock timing chain guide, the stock timing chain tensioner, the stock timing chain, the stock crankshaft sprocket, and the stock camshaft sprocket from the internal combustion engine with a plurality of hemispherical combustion chambers.

7. The method for retrofitting high performance camshafts to gasoline-fueled piston engines as claimed in claim 1 further comprises the steps of:

providing the stock camshaft drive assembly, wherein the stock camshaft drive assembly comprises a stock timing chain guide, a stock timing chain tensioner, a stock timing chain, a stock crankshaft sprocket, and a stock camshaft sprocket;

providing the performance camshaft drive assembly, wherein the performance camshaft drive assembly comprises a performance timing chain guide, a performance timing chain tensioner, a performance timing chain, a performance crankshaft sprocket, and a performance camshaft sprocket;

installing the performance timing chain guide in place of the stock timing chain guide;

installing the performance chain tensioner in place of the stock timing chain tensioner;

installing the performance camshaft sprocket in place of the stock camshaft sprocket;

installing the performance crankshaft sprocket in place of the stock crankshaft sprocket; and installing the performance timing chain in place of the stock timing chain.

8. The method for retrofitting high performance camshafts to gasoline-fueled piston engines as claimed in claim 1 further comprises the steps of:

providing the performance camshaft drive assembly, wherein the performance camshaft drive assembly comprises a performance chain tensioner; and removing a portion of the timing cover in order to provide clearance for the performance chain tensioner.

9. The method for retrofitting high performance camshafts to gasoline-fueled piston engines as claimed in claim 1 further comprises the steps of:

providing the internal combustion engine with a plurality of hemispherical combustion chambers, wherein the internal combustion engine with a plurality of hemispherical combustion chambers further comprises a plurality of old gaskets;

providing a plurality of new gaskets; and installing the plurality of new gaskets in place of the plurality of old gaskets.

10. A method for retrofitting high performance camshafts to gasoline-fueled piston engines comprises the steps of:

providing an internal combustion engine with a plurality of hemispherical combustion chambers, wherein the internal combustion engine with a plurality of hemispherical combustion chambers comprises a timing cover, an oil pump, a stock timing chain guide, a stock timing chain tensioner, a stock timing chain, a stock crankshaft sprocket, a stock camshaft sprocket, a camshaft locating plate, a stock camshaft, a variable camshaft timing (VCT) control solenoid, a plurality of displacement-on-demand (DOD) control solenoids, and a plurality of cam followers;

providing a camshaft retrofitting kit, wherein the camshaft retrofitting kit comprises a plurality of DOD plugs, a VCT plug, a performance camshaft, a performance timing chain guide, a performance timing chain tensioner, a performance timing chain, a performance crankshaft sprocket, a performance camshaft sprocket, a plurality of spacers, and an assembly lubricant, and wherein the performance camshaft comprises a plurality of bearing journals;

removing the timing cover, the oil pan, the stock timing chain guide, the stock timing chain tensioner, the stock timing chain, the stock crankshaft sprocket, the stock camshaft sprocket, the camshaft locating plate, the stock camshaft, the VCT control assembly, the plurality of DOD control solenoids, and the plurality of cam followers from the internal combustion engine with a plurality of hemispherical combustion chambers;

installing the plurality of DOD plugs in place of the plurality of DOD control solenoids;

installing the VCT plug in place of the VCT control assembly;

applying the assembly lubricant to the plurality of bearing journals;

installing the performance camshaft in place of the stock camshaft;

reinstalling the camshaft locating plate;

installing the performance timing chain guide in place of the stock timing chain guide;

installing the performance chain tensioner in place of the stock timing chain tensioner;

installing the performance camshaft sprocket in place of the stock camshaft sprocket;

installing the performance crankshaft sprocket in place of the stock crankshaft sprocket;

installing the performance timing chain in place of the stock timing chain;

reinstalling the oil pump and the timing cover;

disassembling the plurality of cam followers, wherein the plurality of cam followers comprises a plurality of springs;

replacing the plurality of springs with the plurality of spacers;

reassembling the plurality of cam followers; and reinstalling the plurality of cam followers.

11. The method for retrofitting high performance camshafts to gasoline-fueled piston engines as claimed in claim 10 further comprises the steps of:

providing a cam adapter; and installing the cam adapter onto the performance camshaft.

12. The method for retrofitting high performance camshafts to gasoline-fueled piston engines as claimed in claim 10 further comprises the steps of:

providing both a performance crankshaft sprocket and a performance camshaft sprocket for the performance camshaft drive assembly, wherein the performance crankshaft sprocket comprises a crank timing mark, and wherein the performance camshaft sprocket comprises a cam timing mark; and aligning the crank timing mark and the cam timing mark.

13. The method for retrofitting high performance camshafts to gasoline-fueled piston engines as claimed in claim 10 further comprises the steps of:

providing a performance camshaft sprocket and a plurality of attach-bolts for the performance camshaft drive assembly; and installing the performance camshaft sprocket with the plurality of attach-bolts.

14. The method for retrofitting high performance camshafts to gasoline-fueled piston engines as claimed in claim 10 further comprises the steps of:

providing the performance camshaft drive assembly, wherein the performance camshaft drive assembly comprises a performance chain tensioner; and removing a portion of the timing cover in order to provide clearance for the performance chain tensioner.

15. The method for retrofitting high performance camshafts to gasoline-fueled piston engines as claimed in claim 10 further comprises the steps of:

providing the internal combustion engine with a plurality of hemispherical combustion chambers, wherein the internal combustion engine with a plurality of hemispherical combustion chambers further comprises a plurality of old gaskets;

providing a plurality of new gaskets; and installing the plurality of new gaskets in place of the plurality of old gaskets.

16. A method for retrofitting high performance camshafts to gasoline-fueled piston engines comprises the steps of:

providing an internal combustion engine with a plurality of hemispherical combustion chambers, wherein the internal combustion engine with a plurality of hemispherical combustion chambers comprises a timing cover, an oil pump, a stock timing chain guide, a stock timing chain tensioner, a stock timing chain, a stock crankshaft sprocket, a stock camshaft sprocket, a camshaft locating plate, a stock camshaft, a variable camshaft timing (VCT) control solenoid, a plurality of displacement-on-demand (DOD) control solenoids, and a plurality of cam followers;

providing a camshaft retrofitting kit, wherein the camshaft retrofitting kit comprises a plurality of DOD plugs, a VCT plug, a performance camshaft, a performance timing chain guide, a performance timing chain tensioner, a performance timing chain, a performance crankshaft sprocket, a performance camshaft sprocket, a plurality of spacers, an assembly lubricant, and a plurality of attach-bolts, and wherein the performance camshaft comprises a plurality of bearing journals, and wherein the performance crankshaft sprocket comprises a crank timing mark, and wherein the performance camshaft sprocket comprises a cam timing mark;

removing the timing cover, the oil pan, the stock timing chain guide, the stock timing chain tensioner, the stock timing chain, the stock crankshaft sprocket, the stock camshaft sprocket, the camshaft locating plate, the stock camshaft, the VCT control assembly, the plurality of DOD control solenoids, and the plurality of cam followers from the internal combustion engine with a plurality of hemispherical combustion chambers;

installing the plurality of DOD plugs in place of the plurality of DOD control solenoids;

installing the VCT plug in place of the VCT control assembly;

applying the assembly lubricant to the plurality of bearing journals;

installing the performance camshaft in place of the stock camshaft;

reinstalling the camshaft locating plate;

installing the performance timing chain guide in place of the stock timing chain guide;

installing the performance chain tensioner in place of the stock timing chain tensioner;

installing the performance camshaft sprocket in place of the stock camshaft sprocket with the plurality of attach-bolts;

installing the performance crankshaft sprocket in place of the stock crankshaft sprocket;

aligning the crank timing mark and the cam timing mark;

installing the performance timing chain in place of the stock timing chain;

reinstalling the oil pump and the timing cover;

disassembling the plurality of cam followers, wherein the plurality of cam followers comprises a plurality of springs;

replacing the plurality of springs with the plurality of spacers;

reassembling the plurality of cam followers; and reinstalling the plurality of cam followers.

17. The method for retrofitting high performance camshafts to gasoline-fueled piston engines as claimed in claim 16 further comprises the steps of:

providing a cam adapter; and installing the cam adapter onto the performance camshaft.

18. The method for retrofitting high performance camshafts to gasoline-fueled piston engines as claimed in claim 16 further comprises the steps of:

providing the performance camshaft drive assembly, wherein the performance camshaft drive assembly comprises a performance chain tensioner; and removing a portion of the timing cover in order to provide clearance for the performance chain tensioner.

19. The method for retrofitting high performance camshafts to gasoline-fueled piston engines as claimed in claim 16 further comprises the steps of:

providing the internal combustion engine with a plurality of hemispherical combustion chambers, wherein the internal combustion engine with a plurality of hemispherical combustion chambers further comprises a plurality of old gaskets;

providing a plurality of new gaskets; and installing the plurality of new gaskets in place of the plurality of old gaskets.

* * * * *